US006908012B1

(12) United States Patent
Pfeifer

(10) Patent No.: US 6,908,012 B1
(45) Date of Patent: Jun. 21, 2005

(54) BEVERAGE DISPENSER WITH AN ADJUSTABLE DRAIN TRAY ASSEMBLY

(75) Inventor: Thomas J. Pfeifer, Louisville, KY (US)

(73) Assignee: Grindmaster Corporation, Louisville, KY (US)

( * ) Notice: Subject to any disclaimer, the term of this patent is extended or adjusted under 35 U.S.C. 154(b) by 0 days.

(21) Appl. No.: 10/307,662

(22) Filed: Dec. 2, 2002

Related U.S. Application Data

(60) Provisional application No. 60/337,188, filed on Dec. 4, 2001.

(51) Int. Cl.[7] ..... B67D 1/16
(52) U.S. Cl. ..... 222/108; 141/86
(58) Field of Search ..... 222/108; 141/86; 137/313; 108/108

(56) References Cited

U.S. PATENT DOCUMENTS

| | | | | |
|---|---|---|---|---|
| 3,704,675 | A | | 12/1972 | Bellasalma |
| 3,998,069 | A | | 12/1976 | Kronenberger et al. |
| 4,076,145 | A | | 2/1978 | Zygiel |
| 4,215,840 | A | | 8/1980 | Babberl |
| 4,429,850 | A | | 2/1984 | Weber et al. |
| 4,587,896 | A | | 5/1986 | Steinke |
| 4,738,285 | A | | 4/1988 | Belland |
| 4,765,575 | A | | 8/1988 | Bergl et al. |
| 4,865,225 | A | | 9/1989 | Chavez et al. |
| 5,004,192 | A | | 4/1991 | Handler |
| 5,063,977 | A | | 11/1991 | Belland |
| D326,795 | S | | 6/1992 | Reitz et al. |
| 5,228,764 | A | | 7/1993 | Cherry et al. |
| 5,390,714 | A | * | 2/1995 | North et al. ..... 141/369 |
| 5,542,572 | A | | 8/1996 | Davis |
| 5,960,995 | A | | 10/1999 | Leatherman et al. |
| D426,089 | S | | 6/2000 | Vlah |
| 6,102,086 | A | | 8/2000 | Holtby |
| D444,657 | S | | 7/2001 | Weber |

* cited by examiner

*Primary Examiner*—Philippe Derakshani
(74) *Attorney, Agent, or Firm*—Stites & Harbison, PLLC; Vance A. Smith; David W. Nagle, Jr.

(57) ABSTRACT

A beverage dispenser includes a back splash wall with a plurality of vertically spaced openings to provide edges for the connection of the drain tray assembly, said drain tray assembly comprising at least one drain opening and a substantially vertical back wall terminating in a channel adapted to receive and be positioned over an edge defined by one the vertically spaced openings of said back splash wall. The drain tray assembly can be vertically adjusted by lifting the channel off one edge of the back splash wall and then repositioning the same over another edge of the back splash wall.

12 Claims, 3 Drawing Sheets

BEVERAGE DISPENSER WITH AN ADJUSTABLE DRAIN TRAY ASSEMBLY

CROSS REFERENCES TO RELATED APPLICATION

This application claims priority from U.S. Provisional Application No. 60/337,188 filed Dec. 4, 2001. The entire disclosure contained in U.S. Provisional Application No. 60/337,188 is incorporated herein by reference.

BACKGROUND OF THE INVENTION

The present invention relates generally to a beverage dispenser, and more particularly, to a vertically adjustable drain tray assembly for a beverage dispenser. Beverage dispensing equipment is well defined in prior art. Most beverage dispensers, particularly those used in commercial enterprises and the food service industry, consist of at least one beverage dispensing nozzle supported by at least one upright structural member of the beverage dispenser, with a drain tray positioned for the collection of residual liquid, including spillage of the beverage being dispensed. Such a drain tray assembly typically includes a collection reservoir suspended beneath a dispensing nozzle at a distance greater than the height of a defined beverage container so that the beverage container may be positioned beneath the dispensing nozzle of the beverage dispenser. Generally, the vertical distance between the dispensing nozzle and the drain tray assembly is fixed, thus making it difficult to accommodate beverage containers of varying sizes.

It is therefore a paramount object of the present invention to provide a beverage dispenser with a drain tray assembly that can be vertically adjusted to alter the distance between the drain tray assembly and the dispensing nozzle.

This and other objects and advantages of the present invention will become apparent upon a reading of the following description.

SUMMARY OF THE INVENTION

The beverage dispenser of the present invention allows for adjustment of the vertical distance between the drain tray assembly and the dispensing nozzle of the beverage dispenser to accommodate beverage containers of varying sizes. The beverage dispenser of the present invention includes a back splash wall with a plurality of vertically spaced openings to provide edges for the connection of the drain tray assembly. The drain tray assembly has a drain tray including at least one drain and a vertically orientated back wall that terminates in a channel adapted to be positioned over an edge defined by one of the vertically spaced openings of the back splash wall. In practice, the drain tray assembly is vertically adjusted by first lifting the channel off one edge of the back splash wall and then repositioning it over another edge of the back splash wall.

DESCRIPTION OF THE FIGURES

A more thorough understanding of the operation and advantages of the present invention can be had by referring to the following detailed description, which refers to the following figures.

DESCRIPTION OF THE PRESENT INVENTION

Figure 1:
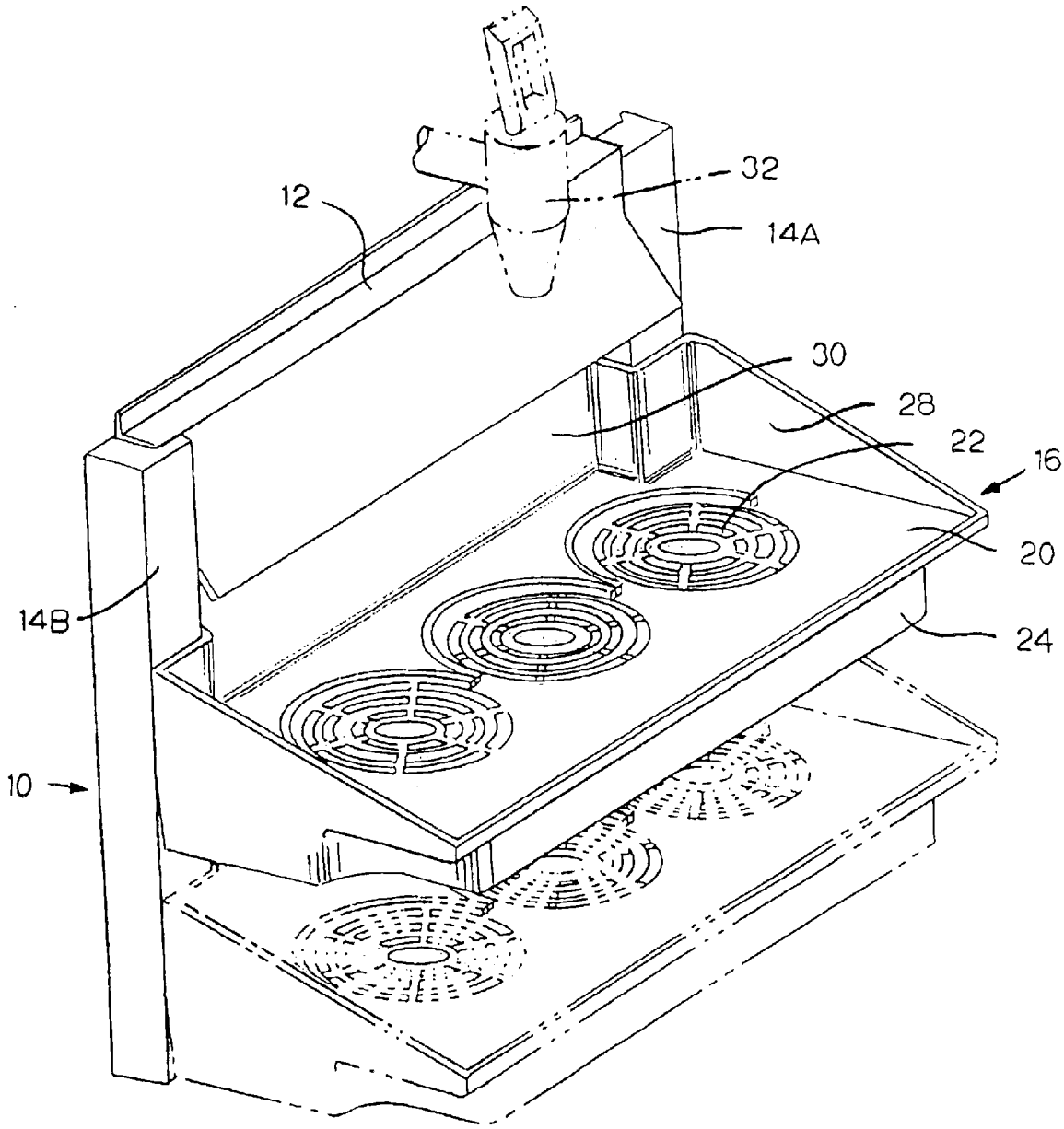
FIG. 1 is a perspective view of a preferred embodiment of a drain tray assembly made in accordance with the present invention.
Figure 2:
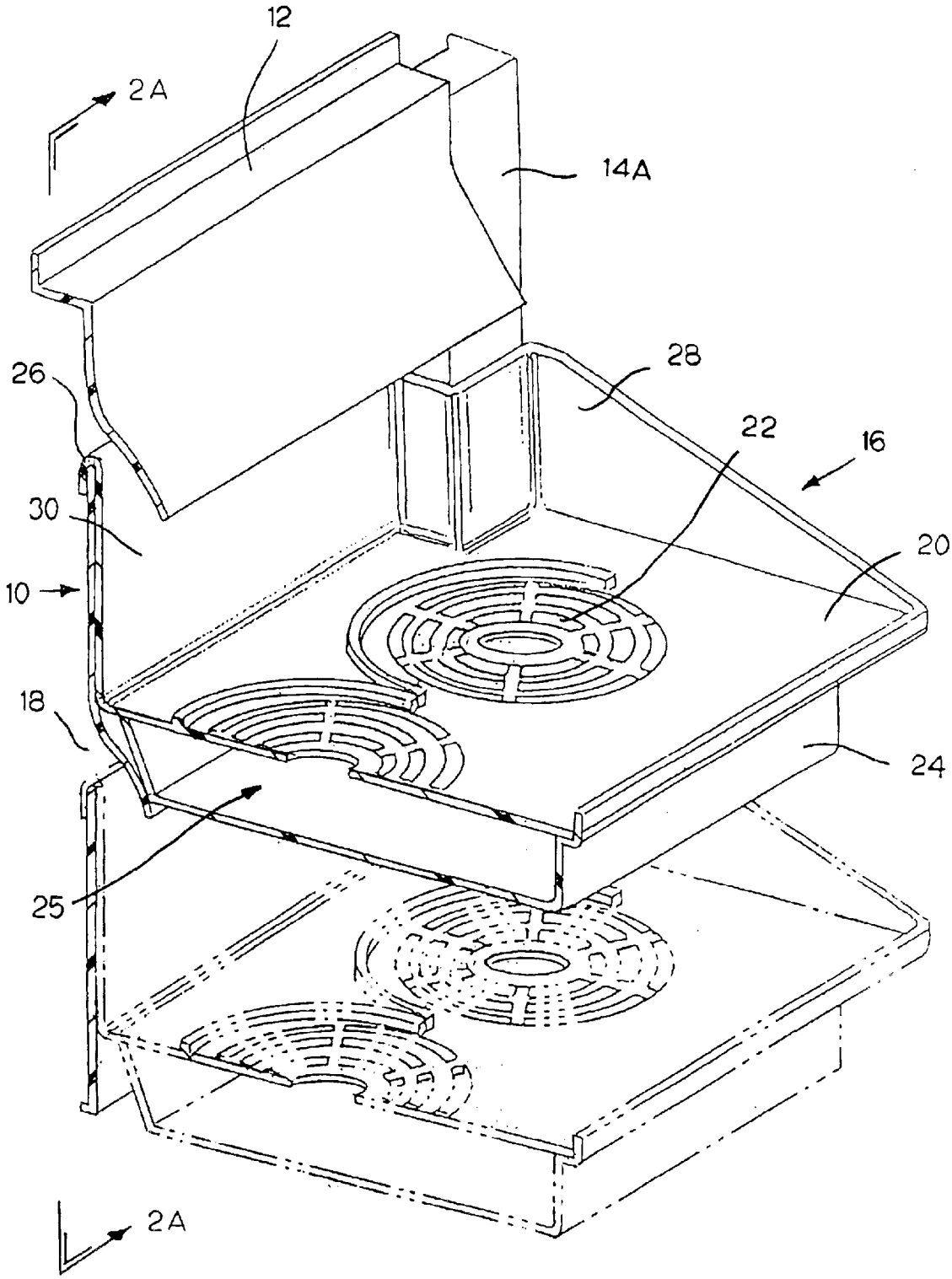
FIG. 2 is a cross-sectional view of the drain tray assembly of FIG. 1.
Figure 2A:
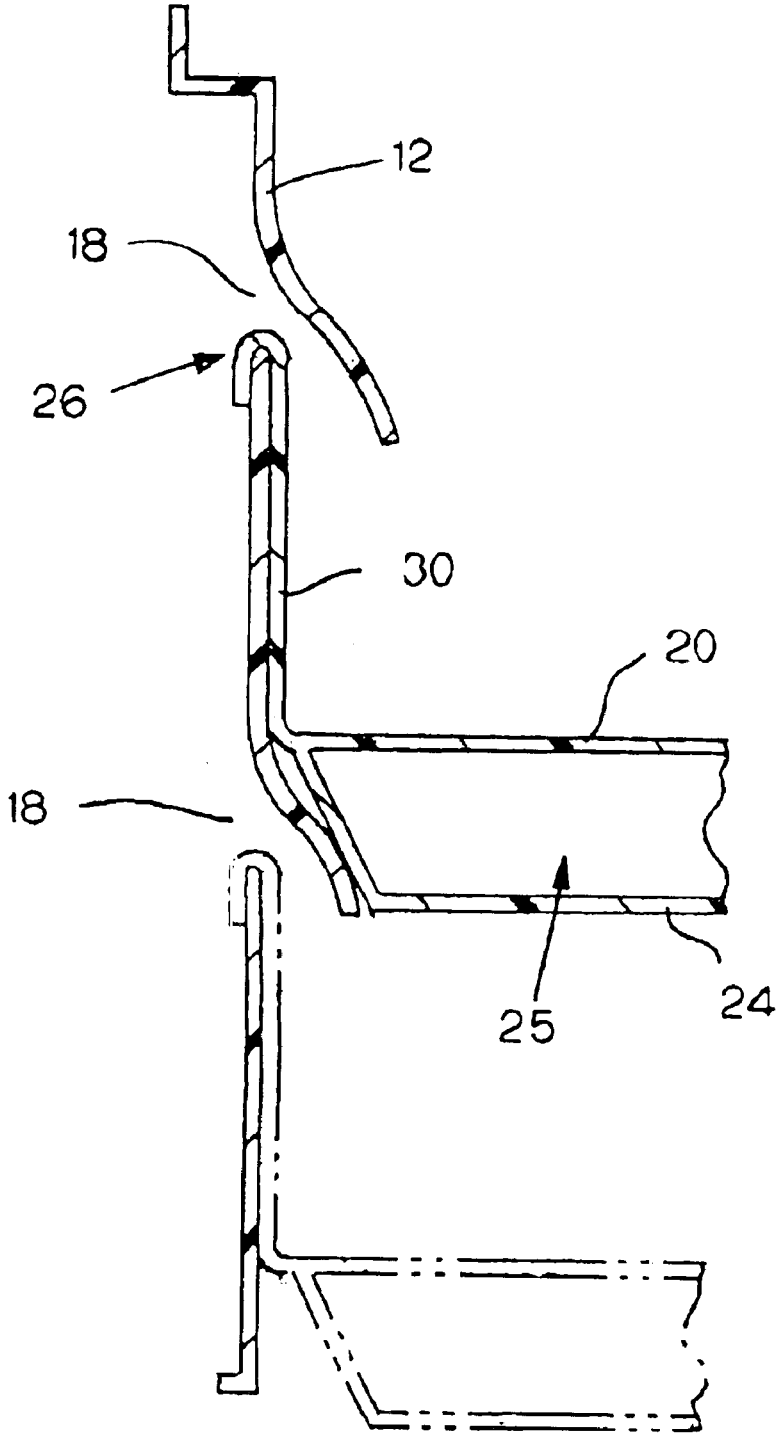
FIG. 2A is a cross-sectional view of the drain tray assembly of FIG. 1.

Reference is first made to the perspective view of FIG. 1, which generally depicts a front portion of a beverage dispenser 10 with a back splash wall 12 positioned between a pair of upright support members 14A, 14B and below a dispensing nozzle 32. The upright support members 14A, 14B are integral to the frame of the beverage dispenser 10. The drain tray assembly 16, which supports a beverage container below the dispensing nozzle 32 and serves as a residual liquid collection apparatus, is shown in two different positions along the length of the back splash wall 12. As best seen in FIG. 2 and 2A, the back splash wall 12 is preferably louvered or contoured at spaced intervals so as to provide several substantially horizontal openings 18 running between the support members 14A, 14B.

The drain tray assembly 16 includes a substantially horizontal upper surface 20 with integral drain openings 22 and a lower molded surface 24, the lower molded surface defining a cavity 25 to collect residual liquid, including beverage dripped from the dispensing nozzle and liquids spilled from a beverage container. The cavity 25 is in liquid communication with the upper surface 20, whereby the drain openings 22 of the upper surface 20 drain into the cavity 25. The components of the drain tray assembly 16, including the upper surface 20 and the lower surface 24, are preferably molded from a thermoplastic material capable of withstanding the temperature differences in a commercial beverage service. Alternatively, these components 20, 24 could be constructed from metal, paper, wood or any other suitable material. In the preferred embodiment, the drains are circular or serpentine in shape to mimic the likely shape of the base of a beverage container; however, the drain openings 22 may be provided in any configuration. Also, in the preferred embodiment, the upper surface 20 is molded to have contoured sides and comers 28 that fit around the upright members 14A, 14B, thereby providing additional structural support to the drain tray assembly 16 in relation to the frame of the beverage dispenser 10.

The drain assembly 16 also has a substantially vertically orientated back wall 30 that terminates in a channel 26. The channel 26 functions to hook over an edge defined by one of the vertically spaced openings 18 of the back splash wall 12. Thus, it can be appreciated that in practice, the drain tray assembly 16 can be vertically adjusted by lifting the channel 26 off one edge of the back splash wall 12 and then repositioned by placing the channel 26 of the assembly 16 over another edge of the back splash wall 18. It will also be appreciated by those of skill that channel 26 can be made of sufficient width to provide for a snug fit over an edge of the back splash wall 12.

It will be obvious to those skilled in the art that other modifications may also be made to the preferred embodiment described herein without departing from the sprit and scope of the present invention.

What is claimed is:

1. In a beverage dispenser adapted to support at least one beverage container below a dispensing nozzle, the improvement comprising:

a back splash wall below said dispensing nozzle with a plurality of substantially vertically spaced openings of a predetermined length to provide substantially horizontal edges; and a removably positioned drain tray assembly having an upper surface, adapted to support at least one beverage container and defining at least one drain opening, and a substantially vertical back wall of a length substantially the same as the predetermined length of said vertically spaced openings, said upper surface abutting said back splash wall and terminating in a channel, said channel adapted to be positioned over an edge of said back splash wall, thereby permitting said drain tray to assembly to be positioned at different vertical heights along the back splash wall of said beverage dispenser.

2. The beverage dispenser of claim 1, wherein said drain tray assembly further comprises a lower surface that defines a cavity that is in liquid communication with said upper surface for collecting liquid draining from said upper surface through said drain opening.

3. The beverage dispenser of claim 2, wherein said lower surface is removably connected to said upper surface.

4. The beverage dispenser of claim 1, wherein said back splash wall is supported by at least one upright support member of the beverage dispenser.

5. The beverage dispenser of claim 4, wherein said upper surface is molded to have contoured sides and corners that fit around said upright support member.

6. The beverage dispenser of claim 1, wherein said drain opening has a circular shape.

7. A residual liquid collection apparatus for use with a beverage dispenser having a dispensing nozzle and a back splash wall defining a plurality of edges, said collection apparatus comprising:

a substantially horizontal upper surface defining at least one drain opening;

a lower surface defining a cavity that is in liquid communication with said upper surface for collecting liquid draining from said upper surface through said drain opening; and a substantially vertical back wall that terminates in a channel adapted to be positioned over a selected edge defined by said back splash wall.

8. The residual liquid of claim 7, wherein each edge of said back splash wall is defined by a respective substantially horizontal opening defined through said back splash wall.

9. The residual liquid collection apparatus of claim 7, wherein said lower surface is removably connected to said upper surface.

10. The residual liquid collection apparatus of claim 7, wherein said back splash wall is supported by at least one upright support member.

11. The residual liquid collection apparatus of claim 10,wherein said upper surface is molded to have contoured sides and corners that fit around said upright support member.

12. The beverage dispenser of claim 7, wherein said drain opening has a circular shape.

* * * * *

UNITED STATES PATENT AND TRADEMARK OFFICE

CERTIFICATE OF CORRECTION

PATENT NO. : 6,908,012 B1
DATED : June 21, 2005
INVENTOR(S) : Pfeifer, Thomas J.

It is certified that error appears in the above-identified patent and that said Letters Patent is hereby corrected as shown below:

Column 4,
Line 10, change to read -- The residual liquid collection apparatus of claim 7, wherein each edge of --.

Signed and Sealed this

Twenty-third Day of August, 2005

JON W. DUDAS
*Director of the United States Patent and Trademark Office*